United States Patent [19]

Burdick

[11] Patent Number: 4,769,518

[45] Date of Patent: Sep. 6, 1988

[54] LATCHING SWITCH OPERATED BY SEQUENTIAL PUSH MOTIONS

[75] Inventor: Robert C. Burdick, Romulus, Mich.

[73] Assignee: United Technologies Automotive, Inc., Dearborn, Mich.

[21] Appl. No.: 69,127

[22] Filed: Jul. 2, 1987

[51] Int. Cl.[4] ..... H01H 13/60

[52] U.S. Cl. ..... 200/153 J; 200/153 LB

[58] Field of Search ..... 200/153 J, 153 LB, 292, 200/252

[56] References Cited

U.S. PATENT DOCUMENTS

| | | | |
|---|---|---|---|
| 2,532,000 | 11/1950 | West | 200/153 LB |
| 2,933,578 | 4/1960 | Hubbell et al. | 200/156 |
| 2,950,372 | 8/1960 | Aspinwall | 200/156 |
| 2,965,737 | 12/1960 | Lewis et al. | 200/156 |
| 3,045,501 | 7/1962 | Wright | 74/142 |
| 3,375,337 | 3/1968 | Barrett et al. | 200/156 |
| 3,513,278 | 5/1970 | Elliott | 200/156 |
| 3,643,043 | 2/1972 | Endow | 200/16 F |
| 4,057,520 | 11/1977 | Schwartz | 200/292 |
| 4,112,278 | 9/1978 | Greiner et al. | 200/156 |
| 4,129,764 | 12/1978 | Ohkita et al. | 200/153 J |
| 4,175,222 | 11/1979 | Buttner | 200/153 J |
| 4,213,017 | 7/1980 | Lewis | 200/5 B |
| 4,520,241 | 5/1985 | Sandi et al. | 200/5 B |
| 4,524,248 | 6/1985 | Levko | 200/5 B |
| 4,575,590 | 3/1986 | Hattori et al. | 200/5 B |

FOREIGN PATENT DOCUMENTS

| | | | |
|---|---|---|---|
| 780981 | 3/1968 | Canada | 200/153 J |

*Primary Examiner*—Renee S. Luebke

[57] ABSTRACT

A latching switch operated by push motions for making electrical connections. A displaceable contact carrier (50) is slidably mounted within an enclosure and has multiple positions for making electrical contacts. A rotatable cam (62) is positioned adjacent the contact carrier and via selected camming surfaces controls the position of the contact carrier. A cam actuator (30) is displaced by push motions and includes a contact surface for engaging the rotatable cam to displace the cam to cause the contact carrier to be placed in the desired position.

13 Claims, 2 Drawing Sheets

LATCHING SWITCH OPERATED BY SEQUENTIAL PUSH MOTIONS

Cross Reference to Related Applications

This application relates to commonly assigned, copending U.S. patent application Ser. No. 69,134, entitled "Modular Push Type Latching and Cross Cancelling Switches" and U.S. patent application Ser. No. 69,135, entitled "A Switch Position Indicator".

TECHNICAL FIELD

The field to which this invention pertains is the field of electrical switches and, specifically, push-push latching electrical switches.

BACKGROUND OF THE INVENTION

The present invention is directed to a push-push type latching switch suitable for use in an automobile or for other applications. The invention utilizes a sliding contact carrier having a cam surface in combination with a rotating cam and a displaceable cam actuator operated by a push button.

The prior art devices have utilized various ratchet mechanisms for controlling actuation of a switch means utilizing a push-push type operation. These devices typically operate a pair of contacts directly from the ratchet mechanism to control either turning the device on or off.

The herein device provides a compact and efficient device wherein a cam is rotated in response to a cam actuator. The rotating cam contacts a cam surface attached to a sliding contact carrier such that a whole series of contacts may be slid between various positions in response to the various camming actions. In this manner, the appropriate electrical connections can be made via the sliding contact carrier. Additionally, the cam actuator may be appropriately sized such that it is held in place oy the contact carrier to promote relative sliding motion between the two.

The basic latching switch as disclosed herein may be combined in pairs with a cross cancelling mechanism as is disclosed in the cross referenced patent application entitled "Modular Push Type Latching and Cross Cancelling Switches" referred to above.

The present switch is designed and is made particularly suitable for modular applications. The cam may be rotated either clockwise or in a counterclockwise direction. The sliding contact carriers may be placed adjacent to each other. Additionally, it may be seen that an interference tab is provided for obtaining a cross cancelling function when desired and when appropriate contact carriers are located in adjacent positions.

SUMMARY OF THE INVENTION

It is an object of the present invention to provide a push-push type latching switch.

It is a yet further object of the present invention to provide an electrical switch which is compact and readily adapted for modular construction.

It is a still further object of the present invention to provide a push-push type switch suitable for automotive applications and having a cam mechanism which may be operated in either rotational direction.

Another object of the present invention is to provide a safe, economical, reliable, easy to manufacture and assemble switch.

Other objects will be apparent from the description to follow and the appended claims.

The above objects are achieved according to a preferred embodiment by the provision of a latching switch operated by push motions for making electrical connections. The switch includes a displaceable contact carrier including at least one first electrical contact and a cam surface. Means for biasing displacement of the contact carrier in a selected manner are also disclosed. A second electrical contact means is positioned to be actively engaged by the first electrical contact when the contact carrier is in appropriate position. A rotatable cam is positioned to interact with the contact carrier cam surface to control the position of the contact carrier and includes cycling ribs. The cam actuator having a push button connected to an actuator body and an actuator extending from the actuator body to engage the cycling ribs of the cam is further disclosed. Upon the application of the push motion to the push button of the cam actuator, the cam actuator is displaced causing the actuator to engage the cycling ribs of the cam to effect displacement of the cam thereby controlling the position of the contact carrier and the relative positioning between the first electrical contact and the second electrical contact means.

Also disclosed is an electrical push button switch having a housing and a printed circuit board connected together to define an enclosure, said printed circuit board including electrical connection means in said housing defining a push button opening, and an electrical contact carrier mounted for reciprocal sliding motion within the enclosure. Said contact carrier includes first electrical contacts for selectively engaging the electrical connection means of the printed circuit board, a cam surface, and a spring means for biasing the contact carrier. A rotatable cam is mounted within the enclosure adjacent the contact carrier cam surface, said cam including planar cam surfaces and pointed cam surfaces coacting with the contact carrier cam surface to effect displacement of the contact carrier relative to the rotatable cam and cycling means for rotating the cam. A cam actuator includes a push button extending through the push button opening and an actuator, said actuator being positioned to engage the cycling means for rotating the cam whereby upon displacement of the push button, the actuator engages the cycling means to rotate the cam thereby displacing the contact carrier.

PREFERRED EMBODIMENT OF THE INVENTION

The herein invention will be described with reference to a particular embodiment. It is understood that other mounting arrangements, more positions than just "on" and "off" positions, and the rotating cam having more than three planar surfaces and six cycling ribs, are all within the scope of the invention. Other modifications will be apparent from the description that follows.

Figure 1:
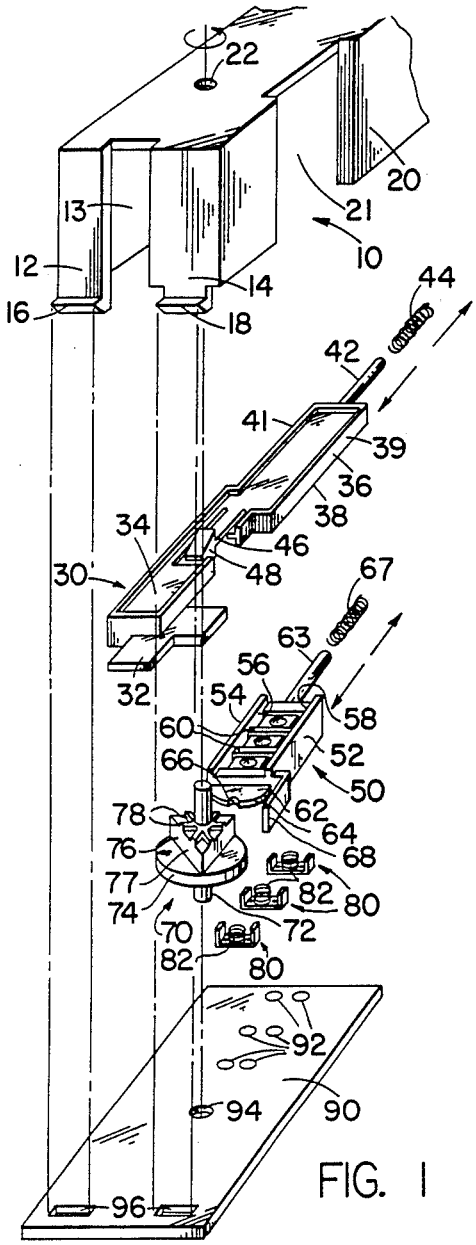
FIG. 1. is an exploded view of the latching switch.

Referring to FIG. 1, there may be seen an exploded view of a latching switch. Housing 10 is shown having legs 12 and 14, each with retaining surfaces 16 and 18, pivot opening 22 and body 20. Retaining surfaces 16 and 18 are designed to engage the leg openings 96 in printed circuit board base 90. When assembled, printed circuit board base 90 and housing 10 collectively define enclosure 21 therebetween. Contacts 92 which typically are traces on a printed circuit board are shown mounted to the printed circuit board base 90 and are the electrical contacts with which the contacts on contact carrier 50 will mate. Additionally, post opening 94 is shown for the receipt of alignment post 72 of cam 70 within the printed circuit board.

Contact carrier 50 as shown is generally rectangular in configuration and includes side plates 52 and 54 which respectively have interior sliding surfaces 58 and 56. The contact carrier further has top surfaces 60 all of which, the sliding surfaces and the top surfaces, effectively define a channel in which the sliding portion of the cam actuator may reciprocate.

Cam 62 is mounted at one end of the contact carrier and includes cam surfaces 64 and detent 66. Additionally, interference tab 68 is shown extending from the end of the contact carrier. In order to bias the contact carrier, a spring retainer 63 extends from the end of the contact carrier and spring 67 is mounted thereabout such that the spring is placed in compression between the housing and the remainder of the contact carrier upon displacement of the contact carrier, and hence urges the contact carrier in the opposite direction. Electrical contacts 80 mounted with springs 82 to the contact carrier extend downwardly therefrom positioned to engage contacts 92 of the printed circuit board base.

Rotating cam 70 is shown mounted adjacent the end of contact carrier 50. Rotating cam 70 includes alignment post 72 by which the rotating cam is secured to the printed circuit board base and to housing 10 for rotational movement. Rotating cam 70 further includes support cylinder 74, cam surfaces 76 formed in cam body 77 and cycling ribs 78. Cam surfaces 76 contact cam surface 64 of the contact carrier to effect appropriate displacement of the contact carrier in the indicated directions.

Shown immediately above the contact carrier is cam actuator 30. Cam actuator 30 includes push button 32 which extends through push button slot 13 as defined between legs 12 and 14 in the housing and is connected to actuator body 34 and actuator sliding portion 36. Sliding portion 36 has side surfaces 39 and 41 which are designed to engage sliding surfaces 58 and 56 of the contact carrier. Additionally, sliding portion 36 has sliding surface 38 formed at the bottom thereof which mates with top surfaces 60 of the contact carrier such that collectively the surfaces define a sliding channel such that the cam actuator is slidably secured within the contact carrier.

Cam actuator 30 additionally includes spring retainer 42 and spring 44 mounted thereon for biasing the cam actuator in a predetermined direction. The cam actuator further has actuator tongue 48 mounted to actuator tongue support 46 secured to the actuator body. The actuator tongue has surfaces which act to engage the cycling ribs of rotating cam 70 to effect displacement thereof.

Figure 4:
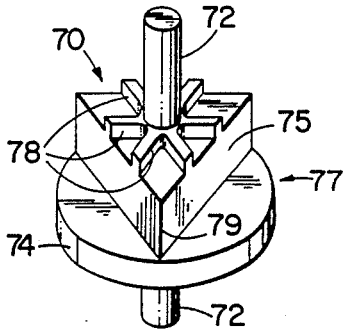
FIG. 4 is a perspective view of the rotating cam.
Figure 2:
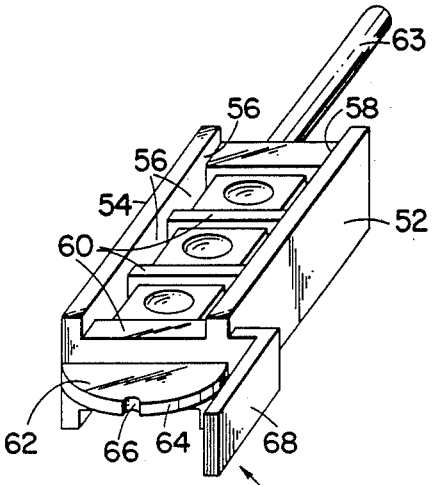
FIG. 2 is a perspective view of the contact carrier.
Figure 3:
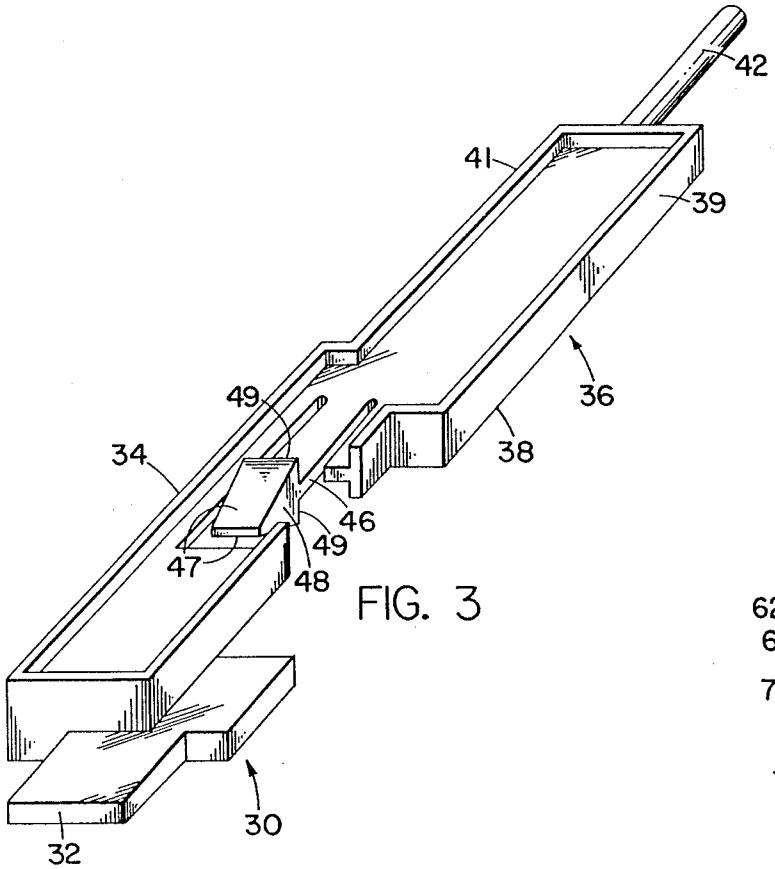
FIG. 3 is a perspective view of the cam actuator.

Referring more particularly to FIGS. 2–4, the basic components of the switch are shown in greater detail. Relative to FIG. 2, it can be seen that top sliding surfaces 60 as well as sliding surface 56 and 58 define a U-shaped channel or sliding channel into which the sliding portion of the actuator is received. Spring retainer 63 is provided at the end of the contact carrier. Cam surface 64 is generally semicircular in configuration and is at the end of cam 62. Detent 66 is a small opening centered at the end of the cam surface. Slide plates 52 and 54 on the edges of the contact carrier are also indicated.

Referring to FIG. 3, an exploded view of the cam actuator is seen. The cam actuator includes push button 32, actuator body 34, and sliding portion 36. Sliding portion 36 includes sliding surface 38 at the bottom, and side surfaces 39 and 41, all of which coact with the appropriate sliding portions of the contact carrier to allow relative sliding motion therebetween. Spring retainer 42 is additionally shown at the opposite end of the cam actuator from push button 32.

Actuator tongue 48 is shown connected by actuator tongue support 46 in a resilient manner to the actuator body. The actuator tongue includes inclined surfaces 47 located on either side thereof, and additionally contact surfaces 49 shown as vertically extending contact surfaces on the opposite side of the actuator tongue from the inclined surfaces.

Referring now to FIG. 4, rotating cam 70 may be seen. Alignment post 72 is shown extending from the top and bottom thereof for mounting the cam for rotational movement. The cam is shown having support cylinder 74 which may mate with the printed circuit board and serves to maintain the cam in alignment. The cam additionally has cam body 77 which includes planar cam surfaces 76 and pointed cam surfaces 79. As shown, there are three each pointed cam surfaces and planar cam surfaces. Additionally, there are six cycling ribs extending from the top of the cam body and arranged to have equal angular displacement therebetween. It is these cycling ribs 78 that contact surfaces 49 of the actuator tongue of the cam actuator engage to effect rotation thereof.

Figure 6:
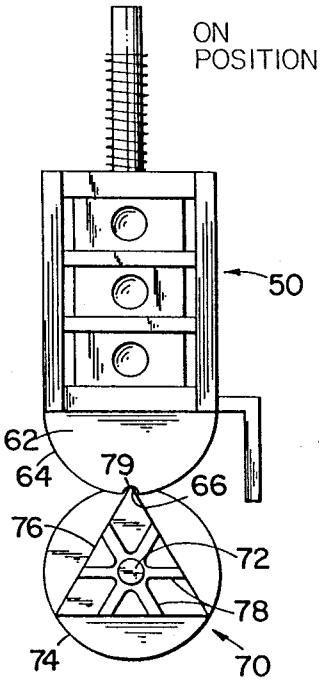
FIG. 6 is a top view of the rotating cam and contact carrier showing the contact carrier in the "on" position.
Figure 5:
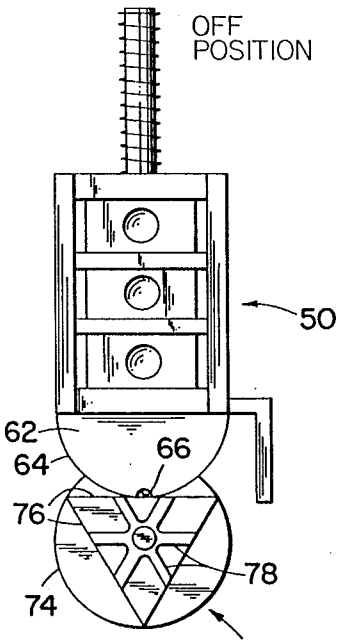
FIG. 5 is a top view of the rotating cam and contact carrier showing the contact carrier in the "off" position.

Referring more specifically to FIGS. 5 and 6, operation of the herein switch may be described. The FIG. 5 switch is shown in what is labeled to be the "off" position (equivalent to the at rest position). Contact carrier 50 is shown having cam 62, detent 66, and cam surface 64. Rotating cam 70 is shown having cycling ribs 78, support cylinder 74 and cam surfaces 76. As seen in FIG. 5, spring 64 has biased the contact carrier such that cam surface 64 is adjacent a planar surface of the cam body allowing the contact carrier to be moved relatively close to the axis of rotation of the rotating cam.

However, comparing FIG. 5 to FIG. 6, it may be seen that the rotating cam has been indexed 60° such that pointed cam surface 79 is now engaged within detent 66 of cam 62. Since the distance between the pointed cam surface 79 and the axis of rotation of the cam is larger than the distance between a planar surface and the axis of rotation of the cam, the contact carrier has been moved away from the axis of rotation of the cam. This is indicated to be the "on" position in FIG. 6.

The motion indicated is caused by a push displacement of push button 32 of the actuator which effects displacement of the entire actuator including the actuator tongue. Contact surface 49 of the actuator tongue acts to engage one of the cycling ribs 78 to cause the cam to rotate 60° as the push button is displaced. The first push of said actuator causes the cam to rotate to the position as shown in FIG. 6. A second push causes the cam to rotate to the position shown in FIG. 5. In this manner, sequential push motions against the push button cause the cam to rotate or index 60° in each event thereby sequentially indexing the contact carrier between the "on" and "off" positions as shown.

Naturally, the rotating cam could have more planar surfaces, more pointed surfaces and more cycling ribs and accomplish the same function. Furthermore, the number of contacts need not be the three contacts as shown in the contact carrier but could be any number of contacts. Additionally, the cam arrangement could provide for sequential incremental displacement of the contact carrier to multiple positions including more positions than simply the "on" and "off" positions as shown. Also the electrical contacts may be traces on a printed circuit board, or molded circuits, or hard wire contacts.

The invention has been described with reference to a particular embodiment herein, it will be understood by those skilled in the art that variations and modifications can be effected within the spirit and scope of the invention.

I claim;

1. A latching switch operated by push motions for making electrical connections which comprises:

a slidably displaceable contact carrier including at least one first electrical contact and a curvilinear cam surface;

means for biasing displacement of the contact carrier in a selected manner;

electrical contact means positioned to be selectively engaged by the first electrical contact;

a rotatable cam having a fixed axis of rotation and positioned to interact with the contact carrier cam surface to control the slidable displacement of the contact carrier and including cycling ribs; and a cam actuator including a push button connected to an actuator body and an actuator extending from the actuator body to engage the cycling ribs of the cam, whereby upon applying a push motion to the push button of the cam actuator, the cam actuator is displaced causing the actuator to engage the cycling rubs of the cam to effect rotational displacement of the cam thereby controlling positioning of the contact carrier and positioning between the first electrical contact and the electrical contact means.

2. The apparatus as set forth in claim 1 and further comprising means for biasing the cam actuator to an at rest position.

3. The apparatus as set forth in claim 1 wherein the contact carrier further defines at least one contact carrier sliding surface and wherein the cam actuator body includes a sliding portion positioned to engage the contact carrier sliding surface for positioning the cam actuator while allowing relative slidable motion between the cam actuator and the contact carrier.

4. The apparatus as set forth in claim 1 wherein the contact carrier cam surface is curvilinear in configuration and wherein the rotatable cam includes a cam surface including pointed cam surfaces and planar cam surfaces and which rotates about an axis of rotation, said pointed cam surfaces extending further from the axis of rotation of the rotatable cam than the planar cam surfaces whereby rotation of the rotatable cam causes the contact carrier to be positioned dependent upon whether a pointed cam surface or a planar cam surface of the rotatable cam engages the contact carrier cam surface.

5. The apparatus as set forth in claim 4 wherein the contact carrier cam surface defines a detent such that in one position of the switch, the pointed cam surface of the rotatable cam is captured within the detent of the contact carrier cam surface.

6. The apparatus as set forth in claim 1 and further comprising:

a printed circuit board for supporting the contact carrier for sliding motion, and said electrical contact means being formed on said printed circuit board.

7. An electrical push button switch which comprises:

a housing and a printed circuit board connected together to define an enclosure, said printed circuit board including electrical connection means and said housing defining a push button opening;

an electrical contact carrier mounted for reciprocal sliding motion within the enclosure, said contact carrier including first electrical contacts for selectively engaging the electrical connection means of the printed circuit board and a cam surface;

a spring means for biasing the contact carrier;

a rotatable cam mounted within the enclosure adjacent the contact carrier cam surface, said cam including planar cam surfaces and pointed cam surfaces coacting with the contact carrier cam surface to effect displacement of the contact carrier relative to the rotatable cam and cycling means for rotating the cam; and a cam actuator including a push button and an actuator, said actuator being positioned to engage the cycling means for rotating the cam whereby upon displacement of the push button, the actuator engages the cycling means to rotate the cam thereby controlling the contact carrier.

8. The apparatus as set forth in claim 7 wherein the contact carrier is placed in a first position when the pointed cam surface engages the contact carrier cam surface and a second position when the planar cam surface engages the contact carrier cam surface.

9. The apparatus as set forth in claim 8 wherein the contact carrier cam surface defines a detent and wherein the pointed cam surface is captured within the detent when the contact carrier is in the first position.

10. The apparatus as set forth in claim 7 and further comprising biasing means for biasing the cam actuator towards an at rest position.

11. The apparatus as set forth in claim 7 wherein the cycling means comprises spaced ribs projecting from the rotatable cam and wherein the actuator includes a contact surface for engaging at least one rib to effect rotation of the rotatable cam.

12. The apparatus as set forth in claim 11 wherein the actuator further comprises an actuator tongue having a contact surface for engaging a rib when the actuator is displaced in one direction, and an inclined surface for guiding the actuator tongue over the ribs of the cycling means without displacing the cycling means when the actuator is displaced in an opposite direction.

13. The apparatus as set forth in claim 7 wherein the contact carrier includes side surfaces and a sliding surface forming a U-shaped sliding area and wherein the cam actuator includes a sliding portion sized to fit within the U-shaped sliding area such that the contact carrier guides the actuator while allowing for relative sliding motion therebetween.

* * * * *

UNITED STATES PATENT AND TRADEMARK OFFICE

CERTIFICATE OF CORRECTION

PATENT NO. : 4,769,518

DATED : September 6, 1988

INVENTOR(S) : Robert C. Burdick

It is certified that error appears in the above-identified patent and that said Letters Patent is hereby corrected as shown below:

Column 1, line 40, after "place" delete "oy" and insert --by--.

Column 5, line 44, after "cycling" delete "rubs" and insert --ribs--.

Signed and Sealed this

Thirty-first Day of January, 1989

*Attest:*

DONALD J. QUIGG

*Attesting Officer*

*Commissioner of Patents and Trademarks*